US006602394B1

(12) United States Patent
Hillebrand

(10) Patent No.: US 6,602,394 B1
(45) Date of Patent: Aug. 5, 2003

(54) ALKALI ZINC NICKEL BATH

(75) Inventor: Ernst-Walter Hillebrand, Wiekede (DE)

(73) Assignee: Walter Hillebrand GmbH & Co. Galvanotechnik, Wickede/Ruhr (DE)

( * ) Notice: Subject to any disclaimer, the term of this patent is extended or adjusted under 35 U.S.C. 154(b) by 0 days.

(21) Appl. No.: 09/744,706

(22) PCT Filed: Jul. 24, 1999

(86) PCT No.: PCT/EP99/05443

§ 371 (c)(1),
(2), (4) Date: Jan. 30, 2001

(87) PCT Pub. No.: WO00/06807

PCT Pub. Date: Feb. 10, 2000

(30) Foreign Application Priority Data

Jul. 30, 1998 (DE) ..... 198 34 353

(51) Int. Cl.[7] ..... C25D 3/56
(52) U.S. Cl. ..... 205/246; 204/252
(58) Field of Search ..... 205/234, 235, 205/236, 238, 245, 246; 204/252

(56) References Cited

U.S. PATENT DOCUMENTS

| | | | | | |
|---|---|---|---|---|---|
| 4,832,812 | A | * | 5/1989 | Brown | 204/275 |
| 5,310,465 | A | * | 5/1994 | Vaughan | 205/246 |
| 5,405,523 | A | * | 4/1995 | Eckles | 205/246 |

FOREIGN PATENT DOCUMENTS

| | | |
|---|---|---|
| DE | 37 12 511 C3 | 6/1995 |
| EP | 0 410 919 A1 | 1/1991 |
| EP | PCT/EP99/05443 | 3/2000 |
| EP | PCT/EP99/05443 | 4/2001 |
| JP | 58093886 A | 6/1983 |
| JP | 4176893 | 6/1992 |

* cited by examiner

*Primary Examiner*—Bruce F. Bell
(74) *Attorney, Agent, or Firm*—Cook, Alex, McFarron, Manzo, Cummings & Mehler Ltd.

(57) ABSTRACT

The anode is separated from the alkaline electrode to avoid undesirable secondary reactions in an alkali zinc nickel electroplating bath.

4 Claims, 1 Drawing Sheet

ALKALI ZINC NICKEL BATH

BACKGROUND OF THE INVENTION

The invention relates to an electroplating bath for plating zinc-nickel coatings, having an anode, a cathode and an alkaline electrolyte.

It is known to coat electrically conductive materials with zinc-nickel alloys in order to improve their resistance to corrosion. To do this, it is customary to use an acidic electrolyte bath, for example, with a sulfate, chloride, fluoropromate [sic] or sulfamate electrolyte. In these processes, it is very difficult and, in practice, generally impossible, in terms of control technology, to achieve a uniform thickness of the zinc-nickel coating on the material to be coated.

For this reason, the alkaline zinc-nickel electroplating baths which are disclosed in German Patent 37 12 511 have recently been used, having, for example, the following composition:

11.3 g/l ZnO 4.1 g/l $NiSO_4*6H_2O$ 120 g/l NaOH 5.1 g/l polyethyleneimine.

The amines contained in the electroplating bath serve as complex formers for the nickel ions, which are otherwise insoluble in the alkaline medium. The composition of the baths varies depending on the manufacturer.

The electroplating baths are usually operated with insoluble nickel anodes. The zinc concentration is kept constant by the addition of zinc and the nickel concentration is kept constant by the addition of a nickel solution, for example, a nickel sulfate solution. However, after they have been operating for a few hours, the color of these baths changes from what was originally blue-violet to brown. After a few days or weeks, this discoloration becomes more intense and it is possible to detect a separation of the bath into two phases, the upper phase being dark brown. This phase causes considerable disruption to the coating of the workpieces, such as, for example, nonuniform layer thickness or blistering. It is therefore imperative for the bath to be continuously cleaned, i.e., for this layer to be skimmed off continuously. However, this is time-consuming and expensive.

Furthermore, after a few weeks of operation it is possible to detect cyanide in the baths. Cyanide pollution requires regular cleaning of the bath and special wastewater treatment, which has a considerable effect on the operating costs of the bath. This applies all the more so if the wastewater has a very high concentration of organics and, with a COD value of approximately 15,000 to 20,000 mg/l, makes cyanide detoxification more difficult. It is then only possible to adhere to statutory wastewater parameters (nickel 0.5 ppm and zinc 2 ppm) by the extensive addition of chemicals.

The formation of the second phase is attributable to a reaction of the amines, which in alkaline solution are converted at the nickel anodes to form nitrites (including to form cyanide). Moreover, on account of the amines being broken down, fresh complex former has to be continuously added to the bath, which increases the costs of the process.

Anodes other than nickel anodes cannot be used, since they dissolve in the alkaline electrolyte, which also has adverse effects on the quality of the coating.

BRIEF SUMMARY OF THE INVENTION

In view of this background, the invention is based on the problem of providing an alkaline zinc-nickel electroplating bath which provides high-quality zinc-nickel coatings at low cost.

To solve this problem, the invention proposes separating the anode from the alkaline electrolyte by an ion exchange membrane.

This separation prevents the amines from reacting at the nickel anode, with the result that there are no undesirable secondary reactions which cause waste disposal problems or lead to a second phase of reaction products being deposited on the bath and adversely affect the quality of the zinc-nickel coating. The invention obviates the need for this layer to be skimmed off at high cost and to renew the bath. Furthermore, there is a considerable improvement in the quality of the coating.

The use of a cation exchange membrane made from a perfluorinated polymer has proven particularly advantageous, since such membranes have a negligible electrical resistance but a high chemical and mechanical resistance.

Furthermore, the cyanide poisoning of the wastewater no longer takes place, thus considerably simplifying the entire wastewater treatment. Furthermore, there is no need to top up the complex former in the electrolyte, since it is no longer broken down and its concentration in the bath remains approximately constant. As a result, the cost of the process becomes considerably less expensive.

In the solution according to the invention, the zinc-nickel bath functions as catholyte. The anolyte used may, for example, be sulfuric acid or phosphoric acid. In the electroplating cell according to the invention, customary anodes, such as, for example, platinum-coated titanium anodes, are suitable as anode material, since they are no longer exposed to the basic zinc-nickel bath.

The present invention is explained in more detail with reference to the exemplary embodiment illustrated in the drawing, in which:

DESCRIPTION OF THE INVENTION

Figure 1:
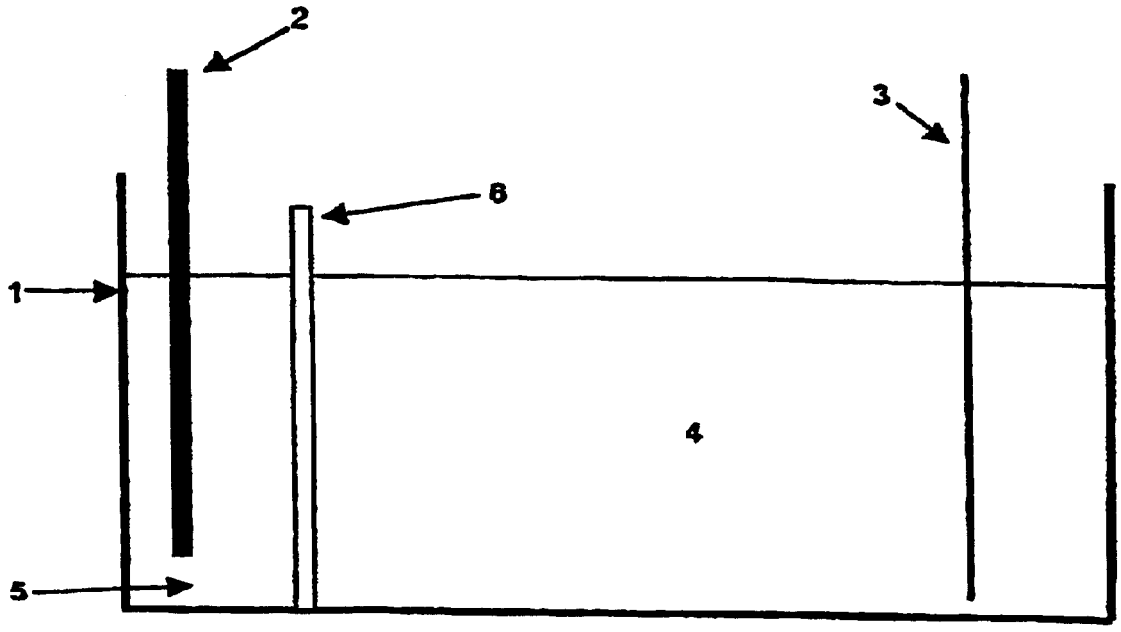
FIG. 1 shows the diagrammatic structure of an electroplating bath according to the invention.

FIG. 1 shows an electroplating cell 1 which has an anode 2 and a cathode 3, which is the workpiece to be coated. The catholyte 4 surrounding the cathode is alkaline and consists of a zinc-nickel electroplating bath of known composition, in which amines are added as complex formers for the nickel ions. The anolyte 5 surrounding the anode 2 may, for example, consist of sulfuric acid or phosphoric acid. Anolyte 5 and catholyte 4 are separated from one another by a perfluorinated cation exchange membrane 6. This membrane 6 allows unimpeded flux of current through the bath but prevents the catholyte 4, in particular the amines contained therein, from coming into contact with the anode 2, thus preventing the reactions which were extensively described in the introduction to the description, including the adverse effects of these reactions.

What is claimed is:

1. Electroplating system for plating zinc-nickel coatings comprising an electroplating cell having an anode (2) and a cathode (3) and an alkaline electroplating bath with an alkaline electrolyte with metal ions for zinc-nickel coating contained within the cell, characterized in that an ion exchange membrane separates the anode from the alkaline electrolyte surrounding the cathode.

2. Electroplating bath according to claim 1, characterized in that the anode is separated from the alkaline electrolyte (4) by a perfluorinated cation exchange membrane (6).

3. Electroplating bath according to claim 1, characterized by sulfuric acid, phosphoric acid, methanesulfonic acid, amidosulfonic acid and/or phosphonic acid as anolyte (5).

4. Electroplating bath according to claim 1, characterized by a platinum-coated titanium anode.

* * * * *